United States Patent [19]

Whitney et al.

[11] 4,017,715

[45] Apr. 12, 1977

[54] TEMPERATURE OVERSHOOT HEATER

[75] Inventors: Wells Whitney, Menlo Park; David August Horsma, Palo Alto, both of Calif.

[73] Assignee: Raychem Corporation, Menlo Park, Calif.

[22] Filed: Aug. 4, 1975

[21] Appl. No.: 601,427

[52] U.S. Cl. ..... 219/553; 219/505; 219/548; 252/511; 264/105; 338/22 R

[51] Int. Cl.[2] ..... H05B 3/10

[58] Field of Search ..... 219/504, 505, 510, 528, 219/543, 548, 552, 553; 338/20, 22 R, 22 D, 211, 212, 338; 174/DIG. 8, 91, 92, 93; 264/25, 105; 252/510, 511, 512

[56] References Cited

UNITED STATES PATENTS

| | | | |
|---|---|---|---|
| 3,067,311 | 12/1962 | Lacy-Hulbert | 219/552 |
| 3,311,862 | 3/1967 | Rees | 338/211 |
| 3,351,882 | 11/1967 | Kohler et al. | 338/322 |
| 3,375,774 | 4/1968 | Fujimura et al. | 338/22 R X |
| 3,412,358 | 11/1968 | Hummel et al. | 338/212 X |
| 3,413,442 | 11/1968 | Buiting et al. | 219/553 |
| 3,535,484 | 10/1970 | Armbruster | 219/528 |
| 3,591,526 | 7/1971 | Kawashima et al. | 252/511 |
| 3,673,121 | 6/1972 | Meyer | 252/511 |
| 3,793,716 | 2/1974 | Smith-Johannsen | 338/20 X |
| 3,823,217 | 7/1974 | Kampe | 264/105 |

OTHER PUBLICATIONS

J. Meyer, "Glass Transition Temperatures as a Guide to the Selection of Polymers Suitable for PTC Materials," *Polymer Engineering and Science*, Nov. 1973, vol. 13, No. 6, pp. 462–468.

T905001, Dec. 1972, Day, 264/25.

*Primary Examiner*—Volodymyr Y. Mayewsky

*Attorney, Agent, or Firm*—Lyon & Lyon

[57] ABSTRACT

Described herein are self-regulating heating articles. The article comprises a constant wattage layer and a layer that exhibits a positive temperature coefficient of resistance (PTC layer). At its steady state condition, the heater is self-regulated by the switching or anomaly temperature $T_s$ of the PTC layer. However, the constant wattage layer has a higher resistance at temperatures below $T_s$ and heats first when the article is connected to a source of electrical power. Means are provided to impede the temperature increase in the PTC layer caused by the heating of the constant wattage layer so that it can heat above $T_s$ before the PTC layer rises to $T_s$ and reduces the current flow to the heater. Further increases in temperature render the PTC layer, for most purposes, non-conductive. Specific impeding means include an electrically conductive, but thermally insulating layer and means that provide for non-uniform heating of the PTC layer so that it remains conductive across a part of its thickness.

40 Claims, 15 Drawing Figures

TEMPERATURE OVERSHOOT HEATER

FIELD OF THE INVENTION

This invention relates to electrical heating articles. More specifically, it relates to self-regulating heating articles. In another aspect it relates to heat recoverable polymeric articles. In yet another aspect, it relates to self heating, heat recoverable articles.

BACKGROUND OF THE INVENTION

A new approach to electrical heating appliances in recent years has been self-regulating heating systems which utilize materials certain types of PTC (positive temperature coefficient) of resistance characteristics. The distinguishing feature of such materials is that upon attaining a certain temperature, a substantial increase in resistance occurs, an increase that for many compositions effectively precludes them from drawing any significant current. Heaters known to the prior art utilizing PTC materials generally exhibit, therefore, a relatively small increase in resistance with increasing temperature change as heating is initiated. However, at some elevated temperature, the resistance begins to increase rapidly with further temperature increase. The temperature (which may be a temperature range) at which the rapid increase in resistance begins to often designated the switching or anomaly temperature ($T_s$). Above $T_s$, resistance can become so high that the current is in effect switched off. Therefore, in actual practice the $T_s$ temperature represents about the maximum temperature to which the PTC heater element will rise. In many applications this has significant advantages over other means of temperature regulation, such as thermostats, fuses or in line resistors, since it eliminates the need for elements that, on a relative basis, can be costly, require added space, be prone to failure or have other shortcomings.

Many well known PTC materials are ceramic in nature. They have numerous applications but their rigidity precludes their use in other instances. However, it is also known that certain electrically conductive polymer compositions exhibit PTC behaviour. Such materials generally comprise one or more conductive fillers such as carbon black or powdered metal dispersed in a crystalline thermoplastic polymer. The most useful types of PTC composition are prepared from highly crystalline polymers and usually exhibit a distinctive rise in resistance a few degrees below the crystalline melting point of the polymer. Accordingly, the $T_s$ of such compositions will be at or near the crystalline melting point of such polymers. A graphical representation of the effect of increasing temperature on resistance for a typical polymeric PTC composition and a time-temperature curve are shown in FIGS. 13 and 14.

There are many applications in which heating elements exhibiting typical PTC character as exemplified are adequate. However, under other circumstances it is desirable that, temporarily at least, the heater element exceed the $T_s$ temperature before the PTC composition exerts its controlling influence to fix the temperature of the heater at $T_s$. In the past, it has been proposed that transient and localized heating of a substrate above the anomaly temperature of a PTC element could be achieved by immersing in the substrate a second heating element connected in series to the PTC element but thermally isolated therefrom. See U.S. Pat. Nos. 3,375,774 and 3,551,644. In these references, the second heating element is selected to have a higher initial resistance than the PTC element. Therefore, when connected to a source of electrical current, the second element heats first and heats the adjacent substrate which may be, for example, the water in a coffee pot. The heated substrate acts as a medium of heat transfer to warm the PTC layer to its anomaly temperature. The temperature stabilizes at this temperture. Many PTC compositions, inasmuch as they are crystalline thermoplastic polymers, if crosslinked, as by ionizing radiation or by chemical means, can be rendered heat recoverable by being deformed above their crystalline m.p. and allowed to cool while deformed. Compositions suitable for use in heat recoverable articles and the methods by which they are obtained, are disclosed, for example, in Cook, U.S. Pat. No. 3,086,242, the disclosure of which is incorporated by reference.

As is now well known, heat recoverable polymeric articles like those disclosed in the Cook patent undergo recovery from their heat recoverable configuration upon being heated without restraint above their crystalline melting point. Most efficient recovery occurs when the temperature of the polymer is well above, for example at least about 10° C above, the crystalline melting point. Typically, the recovery of heat recoverable articles is effected by heating the article with a torch or other open flame.

A frequent application of polymeric heat recoverable articles is as protective coverings about substrates, for example, elongate objects such as pine or electrical cable, where a splice has been made. One method by which this can be done is to install a tube of heat recoverable material capable of recovering to a smaller diameter over the substrate, heating it to achieve recovery. In most applications this heat is supplied by an open flame as described above.

However, as will be apparent to those skilled in the art, there are many applications in which the use of an open flame is unacceptable, for example, in mines or other relatively close places wherein explosive gases can be present, where space limitations are critical or where the protected article is delicate.

In view of the foregoing, as might be expected, it has been proposed to employ electrically self-heating, heat recoverable articles in such instances. This can be done by using conductive polymeric compositions like those previously described in the recoverable member. However, if the recoverable article comprises a conductive polymer having PTC properties, the temperature will only reach $T_s$, which may be too low to bring about rapid and/or complete recovery. Of course a non-PTC conductive polymer could be used. However, though such a composition may be safely employed where open flames are dangerous it can still overheat and damage itself or the delicate components it encapsulates unless closely monitored by a workman or unless precautions such as thermostats or fuses are employed. When these additions are required, many of the advantages of a self-heating article are no longer present.

One solution to this problem has been to employ in heating elements compositions that continue to exhibit PTC behavior above the crystalline melting point. Compositions exhibiting such behaviour, including those comprising a crosslinked blend of an elastomer and a thermoplastic are described in Horsma et al., "Positive Temperature Coefficient of Resistance Compositions,"Ser. No. 601,639, having the same assignee as the present invention, the disclosure of which is incorporated by reference. Though valuable in many applications such compositions are not suited for all purposes.

Accordingly, it is an object of this invention to provide improved self heating articles that are self-regulating.

It is another object of this invention to provide novel heaters regulated by PTC compositions that transiently exceed the temperature controlled by the PTC composition.

Yet another object of this invention is to provide a self heating heat recoverable article that is self-regulating.

SUMMARY OF THE INVENTION

According to the present invention, there is provided a self heating article that is self-regulating comprising a laminar structure of a layer of material exhibiting a positive temperature coefficient of resistance (PTC layer) whose switching temperature is $T_s$, at least one constant wattage layer (CW layer) whose ohmic resistance below $T_s$ is higher than that of the PTC layer and means for impeding the temperature increase in the PTC layer relative to the CW layer when the article is connected to a source of electrical power so that it remains conductive until the temperature of the CW layer rises above $T_s$.

In presently preferred embodiments of the invention, the impeding means can be a constant wattage layer of relatively low resistance that is disposed between said PTC and CW layers to insulate the PTC layer thermally.

In other presently preferred embodiments, the impeding means comprises means by which the PTC layer is heated non-uniformly so that it remains conductive through its thickness until the CW layer is heated above $T_s$. This can be accomplished by electrode placement or by variations in the relative thickness of the CW layer (or layers) or the PTC layer.

The CW and/or PTC layers in the article of this invention may comprise conductive polymer compositions. Preferred articles comprise compositions that are heat recoverable or can be heat recoverable.

DETAILED DESCRIPTION OF THE INVENTION

Figure 1:
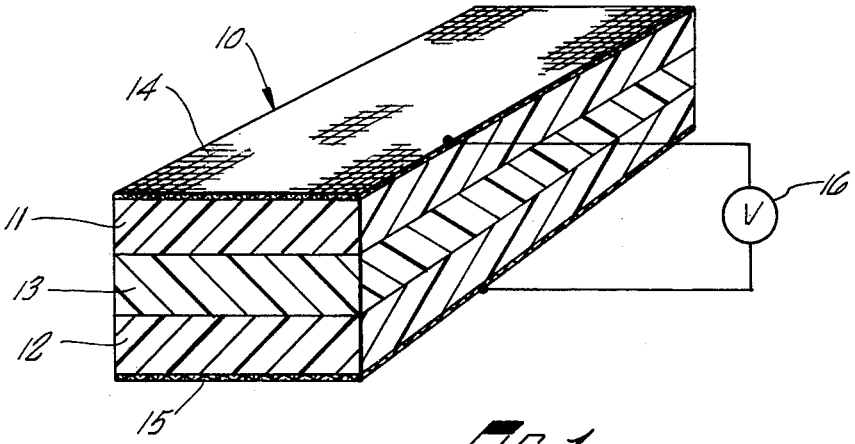
FIGS. 1–12 depict, in perspective, heating articles according to the present invention.

As indicated above, the present invention comprises a layer of a material having a positive temperature coefficient of resistance (PTC layer) and at least one constant wattage layer. For the purposes of this specification a constant wattage layer can be regarded as being a layer of conductive material other than a PTC layer. Preferred constant wattage layers are those whose resistance does not increase by a factor greater than about six in any 30° segment above about 125° C. Preferably, at 25° C they exhibit a resistance higher than that of the PTC layer. Materials for such layers are well known.

Materials exhibiting a positive temperature coefficient of resistance are also well known to the art. For example, a doped barium titanate, ceramic in nature, has been widely employed. Preferably, the PTC materials useful in this invention will exhibit at least a six fold increase in resistance over a 30° C range beginning at $T_s$. The present invention is applicable to heaters made from constant wattage or PTC layers whatever their nature. However, for many applications it is preferred to employ constant wattage layers and PTC layers based upon organic polymer compositions. Accordingly, the present invention will be described in detail with particular regard to its application to heating articles employing polymeric materials.

The thermoplastic polymers used in the preparation of both PTC layer and constant wattage layers are preferably crystalline. Inasmuch as in particularly preferred embodiments it is necessary to employ heat recoverable members and also because the heating articles of the present invention are expected to be employed above the crystalline melting point of the polymers employed, it is particularly preferred that the polymers be crosslinked to impart structural integrity to them above their melting point (or range).

The preferred compositions useful for preparation of the PTC and constant wattage layers comprise a crystalline polymer having sufficient conductive filler, for example, particulate carbon black or metals, so that it is capable of conducting an electrical current at a given voltage, such as 12–36 volts from a battery or 115 volt A.C. The composition should also exhibit sufficient ohmic resistance so that its $I^2R$ heat output is capable of effecting recovery of the polymer compositions that form heat recoverable members which may be several hundred mils thick. Suitable polymers for use in these compositions can be selected from a wide variety of candidates. Particularly useful are crosslinked crystalline polymers such as those disclosed in the aforementioned Cook patent, U.S. Pat. No. 3,086,242. Such polymers can be deformed above their crystalline melting point or range (hereinafter m.p.) and held there until cool to be rendered heat recoverable. It will be appreciated by those skilled in the art that typically a "heat recoverable" polymeric article will exhibit the phenomenon of "elastic memory" which is to say that, if again heated above the m.p. of the polymer, it will return to the shape from which originally deformed unless restrained in some way. In its heat recoverable state the article is frequently said to be heat unstable or dimensionally unstable. By analogy, in its recovered state the article is regarded as heat stable or dimensionally stable.

As has already been indicated, the article of the present invention comprises both a PTC layer and a constant wattage layer. The conductive polymer compositions just described lend themselves to both uses. Compositions exhibiting one or the other property are known to the prior art. In many instances the same base polymer can be used as a component of both the PTC layer and the constant wattage layer. In such cases, the constitution of the constant wattage layer usually differs from that of the PTC layer by having a larger amount of conductive filler. PTC compositions and constant wattage materials useful in the present invention are described at length in concurrently filed application, Horsma et al, "Layered Self-Regulating Heating Article, " Ser. No. 601,638 having the same assignee as the present invention.

Bearing in mind that the present invention is not limited to articles based upon polymer compositions, the presently preferred embodiments of the heating article of the present invention will be described with reference to the accompanying drawings.

FIG. 1 depicts a laminar heating article 10 according to the present invention in which layer 11 represents a constant wattage layer of higher resistance than PTC layer 12 at temperatures below the $T_s$ of layer 12. Disposed between layers 11 and 12 is a layer 13 to thermally insulate layers 11 and 12. Layer 13 is also a constant wattage layer having a lower resistance than layer 11 and, preferably, equal to or lower than that of PTC layer 12. Suitable materials for layer 13 include for example, a structure as shown in FIG. 1 comprising foamed polymeric material having highly electrically conductive pathways throughout. These pathways may be provided by employing a conductive filler in the polymer or by embedding conductive fibrils, threads or wire in the formed materials. Other suitable materials include, for example, materials that can isothermally absorb heat, for example, by undergoing a phase change such as melting, preferably at a temperature higher than the $T_s$ of the PTC layer 12, although if, for example, an adhesive is required to be activated after recovery of a heat recoverable article without damaging a lower melting substrate, a temperature lower than the $T_s$ of the PTC layer may be preferred.

As shown in FIG. 1, article 10 is provided with electrodes 14 and 15 in the form of a metallic mesh or grid. It should be appreciated that other electrode types can be employed in this embodiment and others shown and described herein. For example, a layer of metallic plate or paint can be employed. The electrodes used need not be fully coplanar with the surfaces of the layers of conductive polymer. They can comprise a plurality of strip electrodes, for example metallic mesh or monofilament or multi-stranded wire of a wide variety of conductive materials. These electrodes may be disposed on the surface of the layers or embedded therein.

A presently preferred strip electrode for use in the articles of this invention that are to be dimensionally deformed to a heat recoverable condition and, subsequently, recovered, is a braided tubular electrode that has been braided about a thermoplastic core. Such an electrode is described in concurrently filed application Horsma et al., "Self Heating Article With Fabric Electrode," Ser. No. 601,549 having the same assignee as the present invention, the disclosure of which is incorporated by reference.

As shown in FIG. 1, layers 11, 12 and 13 and electrodes 14 and 15 are connected in series to a source of current 16 which may be a battery or A.C. outlet.

When the article is provided with electrical power, heat generation will initially take place in layer 11 since its resistance is higher than layers 12 and 13. The heat generated will raise the temperature of layer 11 at a rate dependent upon the heat capacity of the material in the layer and the rate of heat loss to the surroundings including layer 13. The heat produced will tranverse layers 13 and ultimately raise the temperature of the PTC layer to above its $T_s$. The time which elapses before the PTC layer attains its $T_s$ and the degree of overshoot, will, of course, depend on the voltage applied, the geometry of the heater, the relative resistances and thermal masses of the layers, the thermal conductance and thermal mass of layer 13 and the thermal losses to the environment, especially to regions adjacent to the constant wattage and PTC layers. Furthermore, the respective rates of heat loss to the environment by layers 11 and 12 will determine the appropriate resistance levels selected for each.

Figure 15:
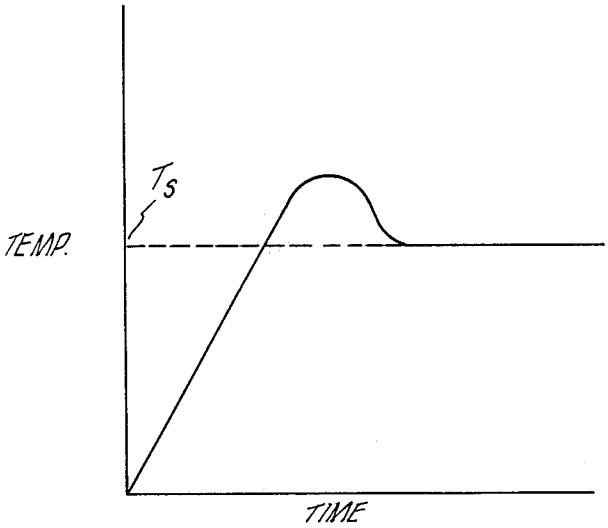
FIG. 15 represents a time-temperature profile that would be exhibited by P.T.c. layer 12 of FIG. 1.

Thus, heat is produced predominently in layer 11 until the PTC layer 12 is heated to or above its $T_s$ temperature at which point, current in the article will effectively be shut off. Under appropriate boundary conditions the temperature in layer 11 will then be higher than layer 13. Because when the current is shut off, the PTC layer is at or just above its $T_s$ and layers 11 and 13 are at higher temperatures, the maximum temperature the PTC layer rises to will be intermediate between these aforesaid temperatures and its particular value and the time which elapses before this maximum is achieved will depend on the hereinabove mentioned factors. Losses of heat to the surrounding, of course, will eventually cause the article to stabilize or reach a steady state in which the PTC layer 12 is near to its $T_s$. A time-temperature profile of the PTC layer 12 might appear as shown in FIG. 15. It should be noted that layers 11 and 13 will rise more quickly to a temperature higher than the maximum attained by the PTC layer and subsequently fall to a steady state temperature at approximately the $T_s$ of layer 12. As a result of this temperature overshoot in PTC layer 12, the current in the heater transiently falls to a value lower than that consumed under the aforesaid "steady state" conditions, i.e., when heat generation balances the heat lost to the environment.

The additional heat generated by the heater overshooting $T_s$ can be enough to occasion recovery of an article, if heat recoverable, whose crystalline m.p. is at or above the $T_s$ temperature of the PTC layer. In other applications, the higher temperature allowed by a heater like that of FIG. 1 would make possible a heater that could be used initially to boil a liquid and then later hold it at a lower temperature, or to activate or cure an adhesive.

From the foregoing discussion it should also be apparent that the material of the constant wattage layer 11 or the thermal delay layer 13 can also be PTC compositions both having a $T_s$ above that of layer 12. In such a configuration, and, provided that boundary conditions permit a temperature overshoot, the PTC character of layer 11 or 13 would advantageously act to limit the maximum overshoot temperature and the character of PTC layer 12 would determine the steady state temperature.

Figure 2:
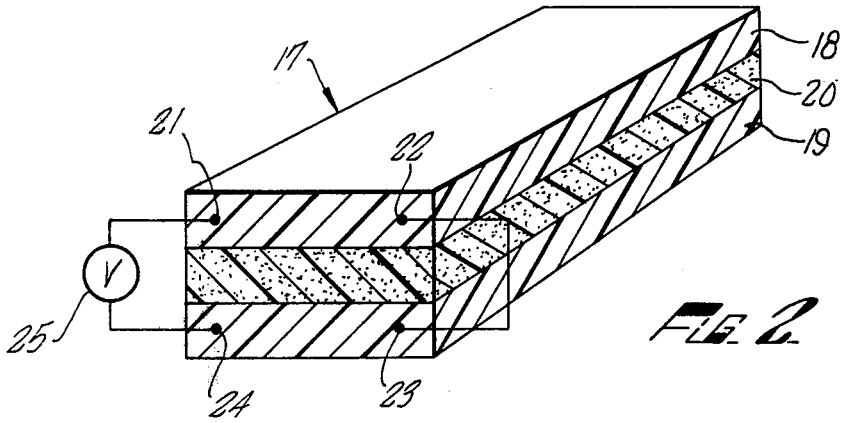

An article 17 similar to FIG. 1 is shown in FIG. 2 in which layers 18 and 19 are, repsectively, a constant wattage layer and PTC layer having properties like those of FIG. 1. However, intermediate layer 20 of article 17 is an electrically insulating as well as a thermally insulating layer. As shown, layer 18 which could preferably be formed from a PTC material having a higher $T_s$ than PTC layer 19, has electrodes 21 and 22 embedded therein whereas PTC layer 19 contains electrodes 23 and 24 embedded therein. Electrode 21 is of opposite polarity than electrode 24 and electrodes 22 and 23 are connected together. When electrical connection is made to power source 25, current is conducted in the planes of layers 18 and 19 between electrodes rather than through the thickness of each of the layers. Otherwise, article 17 functions as a temperature overshoot heater in a manner similar to that of FIG. 1.

If article 17 is a heat recoverable article, preferably electrodes 21–24 are fabric electrodes are previously described.

Figure 3:
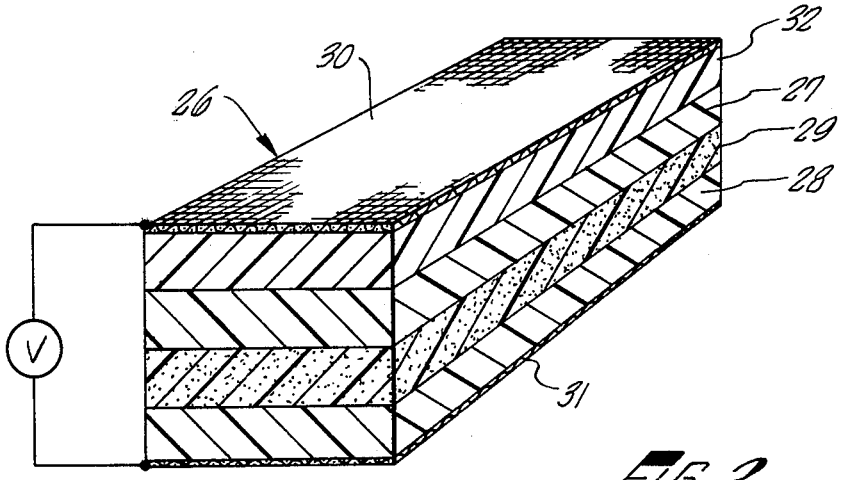

FIG. 3 depicts a yet another article 26 according to the present invention similar to that of FIG. 1 in which layers 27 and 28 are the constant wattage and PTC layers respectively. Layer 29 is a thermally insulating layer like that of layer 13 of FIG. 1. Also, as in FIG. 1, the article is shown as having mesh or grid electrodes 30 and 31. Layer 32 as shown in a storage layer for heat generated in layer 27. As shown, all the layers are electrically conductive, including layer 32 and are connected in series. Layer 32 should have a high thermal conductivity and thermal mass. It can be a metallic layer, for example, by providing more massive electrode structures. For heat recoverable articles it is often and preferably polymeric, most preferably a crystalline polymer whose melting point is below the maximum temperature to which layer 27 rises and above the $T_s$ of the PTC layer 28. The phase change associated with melting of the layer 32 will serve to store heat which will be released as required and preferably after the PTC central layer exceeds its $T_s$ and effectively switches off the heater and the temperature of each layer of the article, at some time thereafter, begins to drop from its maximum. Layer 32 need not be an electrically conductive layer, e.g. it could form part or all of the substrate to which the heater is affixed. In such an instance, electrode 30 should be disposed between layers 32 and 27 or be embedded in layer 27.

Such an article, if provided with sufficient power to more than balance the heat losses to the environment, will warm the storage layer 32. This warming will serve to melt the storage layer said phase change serving to store heat energy. Any part of the environment below the temperature of the storage layer will be warmed by its stored energy. As in the previous instance, and assuming similarly appropriate conditions, because the PTC layer is at about its $T_s$ when the heater switches off and said temperature is below the temperature of the constant wattage, delay and storage layers, a similar temperature overshoot will occur.

Figure 4:
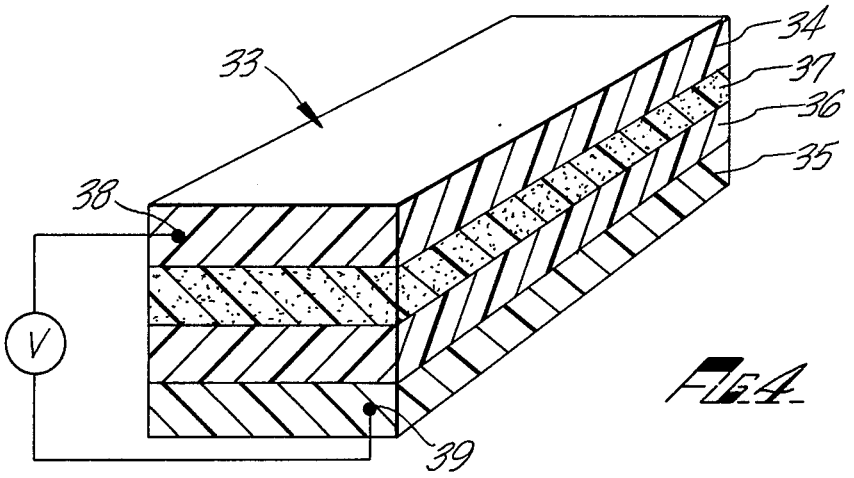

In FIG. 4 is shown another article 33 according to the invention in which layers 34 and 35 are constant wattage layers, layer 34 having the highest resistance. Layer 36 is a PTC layer of lower initial resistance than either 34 or 35. Layer 37 is a thermally insulating layer. Layers 34 and 35 are provided with electrodes, parallel to each other but diagonally disposed in the article. When electrically powered, the current path is preferably predominantly in the plane of layers 34 and 35 (which heat faster than the PTC layer) and predominantly normal to the plane of layers 36 and 37.

This object can be achieved by keeping the resistance of the constant wattage layers higher than that of the PTC and thermal delay layers. It should be noted that the electrical resistance of a layer, whether PTC, constant wattage or delay is determined by its volume resistivity, its geometry and the current path therein. It is desired, for optimum operation of a temperature overshoot heater, to control the volume resistivity, thickness, geometry and electrode placement so that the power density in the constant wattage layer is greater than that in the PTC or delay layers below $T_s$. This is accomplished in the above embodiment and other later to be described embodiments by providing a higher volume resistivity but a lower resistance in the PTC and delay layers (because current flow is predominantly through these layers) and by having a lower volume resistivity but a higher resistance in the constant wattage layers because here the current flow is predominantly in the plane of these layers.

Figure 5:
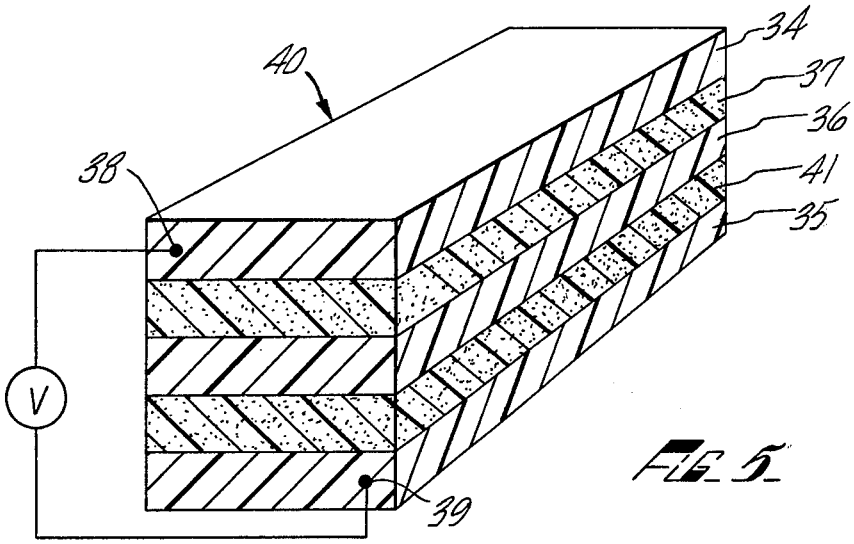

If desired, a thermally insulating delay layer can be disposed between layers 35 and 36 in the article of FIG. 4. Such an article 40 is shown in FIG. 5, wherein like numbers denote like elements between FIGS. 4 and 5. In FIG. 5, layer 41 is a thermally insulating delay layer. Unlike in the article of FIG. 4, constant wattage layers 34 and 35 can be of the same resistance and thus similar in heating capacity in article 40. Also, diagonal electrodes can be replaced by mesh electrodes as shown in FIG. 1, or by other electrode arrangements to give a conductive path generally normal to the plane of all the layers. If this last embodiment is used the volume resistivity and resistance of layers 34 and 35 has to be greater than that of the PTC layer 36.

Figure 6:
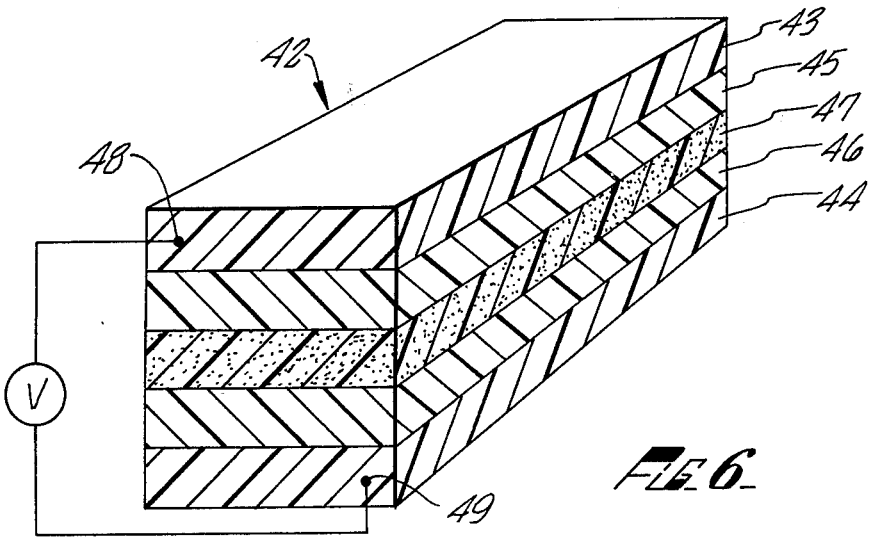

In FIG. 6 is depicted a particularly useful article 42 in which layers 43 and 44 are constant wattage layers. Layer 43 is selected to have the highest resistance. Layers 45 ad 46 are PTC layers. However, layer 45 is selected to have a higher $T_s$ than layer 46. Layer 47 is a thermally insulating layer of low resistance as previously described. Electrodes 48 and 49 are disposed diagonally across the article from each other and are embedded in layers 43 and 44 respectively. When electrically powered by current source 50, layer 43 heats first until layer 45 reaches its $T_s$, which $T_s$ is higher than the steady state temperature desired and thus provides an upper limit to the temperature overshoot. Layer 47 and consequently 46 in turn become hotter so that eventually the article equilibrates to about the $T_s$ of layer 46. Prior to that however, the article will overshoot that temperature to a maximum less than, but controlled by the $T_s$ of layer 45 and by the amount of heat stored in layers 43 and 45 and by the other factors hereinabove described.

Although the previous figures depict monolithic electrodes, it will be realized by those skilled in the art that in all these instances a plurality of electrodes independently selected for each polarity can be used. Further, by appropriate selection of the position spacing and number of electrodes of each polarity the advantageous objects of the instant invention can be achieved as illustrated above, and described in greater particularly hereinafter.

Figure 7:
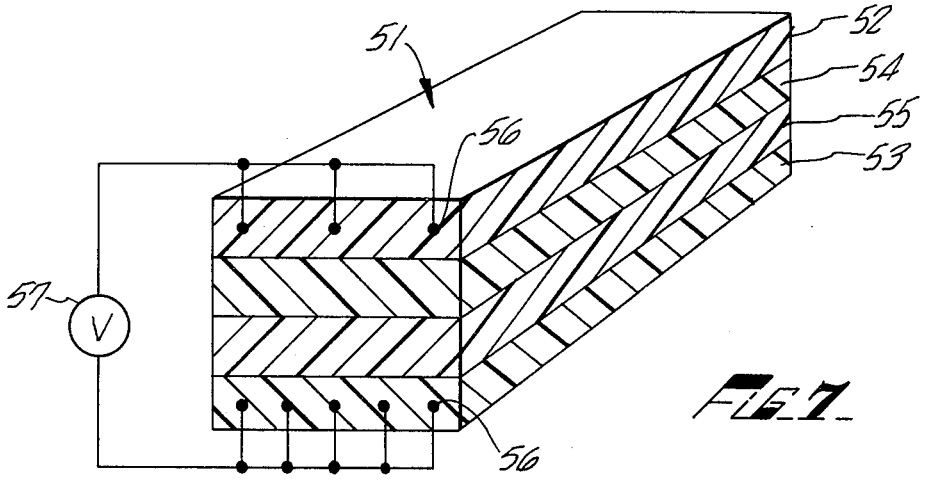
Figure 8:
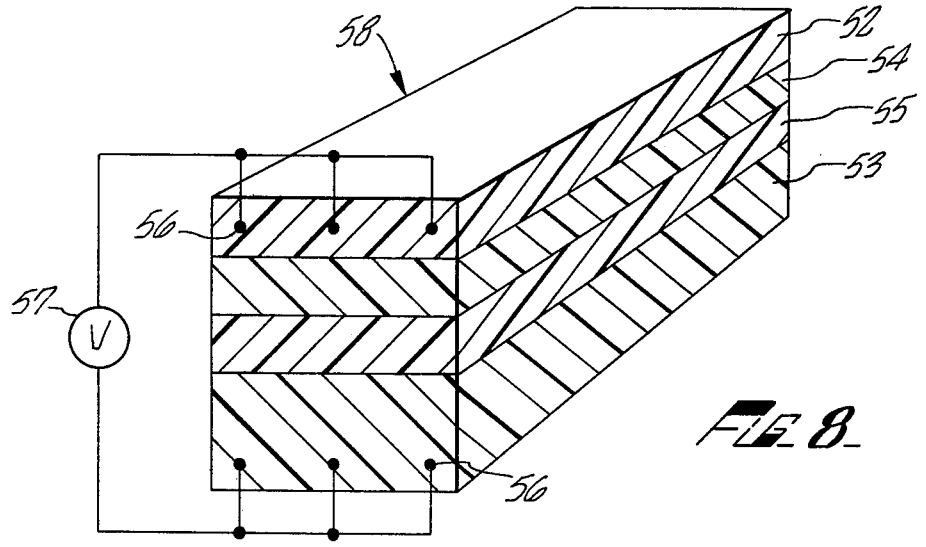

FIGS. 7 and 8 depict articles according to the present invention in which the resistance in the constant wattage layers can be varied. In FIGS. 7 and 8, like numbers denote like elements. The article 51 of FIG. 7 comprises constant wattage layers 52 and 53. Layers 54 and 55 are, respectively, a thermally insulating layer and a PTC layer. In layers 52 and 53 are disposed strip electrodes 56. However, in layer 52 the distance between electrodes is greater thereby causing the resistance in that layer to be greater than that of layer of 53 if they are otherwise the same, i.e. have the same resistivity and dimensions. Thus when powered by source 57, layer 52 will heat first.

FIG. 8 depicts an article 58 similar to article 51 except that layer 53 is relatively thicker than in FIG. 7 and contains the same electrode spacing as layer 52. In this article, because resistivities are chosen to give predominantly an in plane current path in layers 52 and 53 (as in FIG. 4) the resistance of layer 52 will again be greater than 53 and it will heat first since it is a thinner layer than 53 if they have the same resistivity because its resistance varies inversely with its thickness.

Figure 9:
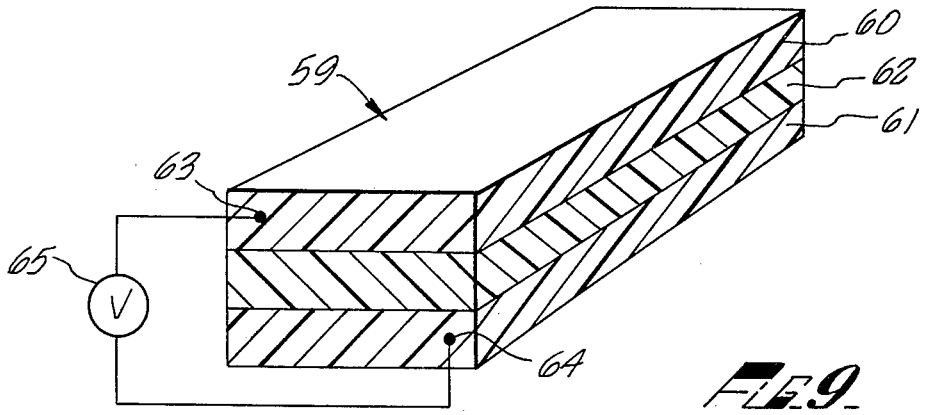

An effect similar to that achieved using a thermally insulating layer to prevent a temperature rise in a PTC layer as shown and described above can be achieved for a multilayer heater element in which means are provided by which the PTC layer is heated across its width non-uniformly. An article 59 having this capability is shown in FIG. 9 in which layers 60 and 61 are constant wattage layers and layer 62 a PTC layer. Layers 60 and 61 have substantially the same and a uniform resistance across their width and that resistance being greater than the resistance of layer 62 below its $T_s$ temperature. In layers 60 and 61 are disposed parallel and diagonally spaced electrodes 63 and 64. Power is supplied by source 65.

Because of the a non-constant distribution of current across the constant wattage layers 60 and 61, much more power ($P = I^2R$) is generated within those layers near the discrete electrodes 63 and 64, which of course may be braided electrodes. Therefore, in this article if the initial power surge is high enough will respect to the heat flux across the heater then the edges containing the electrodes will heat initially to a higher temperature than the middle of the heater.

Thus, even though the temperature of the PTC layer 62 near its edge may exceed $T_s$ and it thereby becomes substantially non-conductive in the regions, the middle of the PTC layer remains conductive. Eventually the conductive pathway through the middle of layer 62 will be pinched off but not before constant wattage layers 60 and 61 and substantial portions of PTC layer 62 have been heated above $T_s$. It should be appreciated that constant wattage layers 60 and 61 may be PTC layers with a higher $T_s$ than layer 62 as before thus controlling the maximum temperature to which the article can be heated as a whole.

Figure 10:
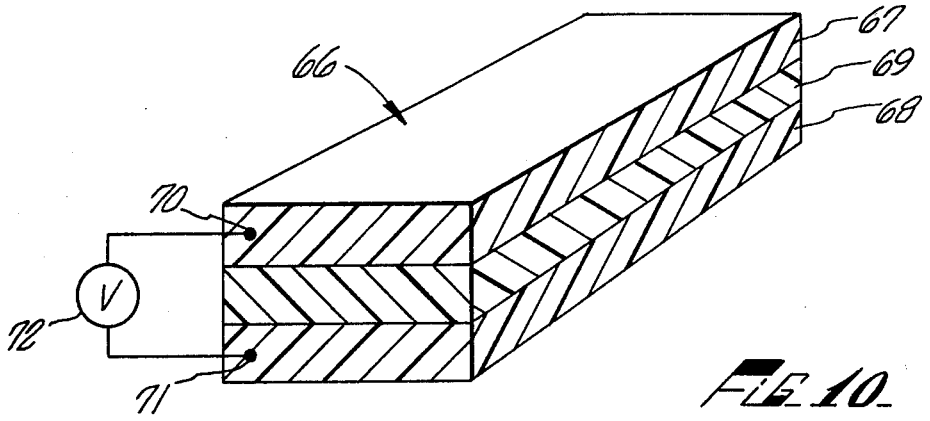

In FIG. 10 is shown an article 66 that functions in a similar manner to that of FIG. 9. Article 66 comprises constant wattage layers 67 and 68 and PTC layer 69 disposed there between. Embedded in layers 67 and 68 are parallel discrete electrodes 70 and 71 whose long axis define a plane normal to that of the heater near one edge. When connected to power source 72, the left edge of the article as shown heats first. The PTC layer remains conductive until it reaches its $T_s$ temperature at the far right side by virtue of the heat reflux moving from left to right. As is true for the article of FIG. 9, by the time all of PTC layer 69 reaches $T_s$, a substantial portion of layers 67 and 68 and PTC layer 69 exceed $T_s$.

Figure 11:
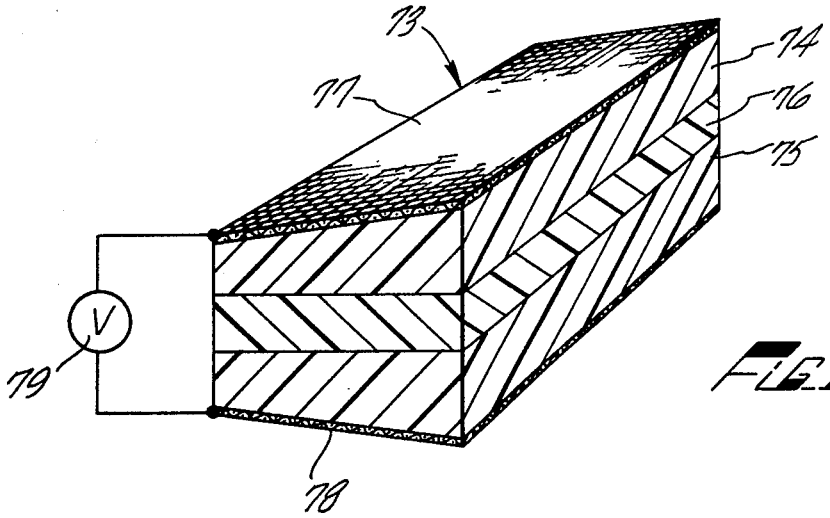

Another article 73 functioning like that of FIG. 10 is shown in FIG. 11 in which layers 74 and 75 are constant wattage layes of non-uniform thickness. Layer 76 is a PTC layer. The outer surfaces of layers 74 and 75 are provided with grid or mesh electrodes 77 and 78 respectively. When connected to power source 79, layers 74 and 75 heat from left to right because their resistance increases with increasing thickness. Because of this non-uniform heating, article 73 functions similarly to that of FIG. 10.

Figure 12:
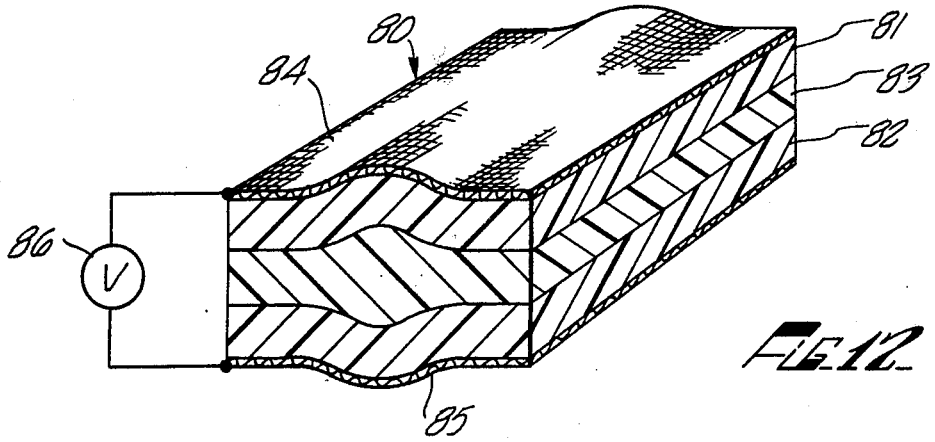
Figure 13:
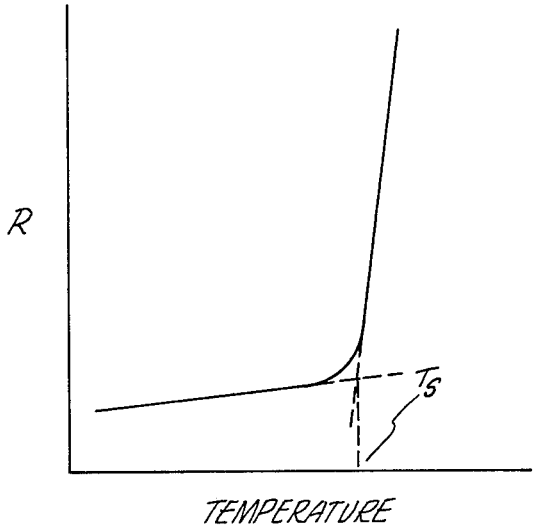
FIG. 13 is a graphical representation of the effect of increasing temperature on resistance for a typical polymeric P.T.C. composition.
Figure 14:
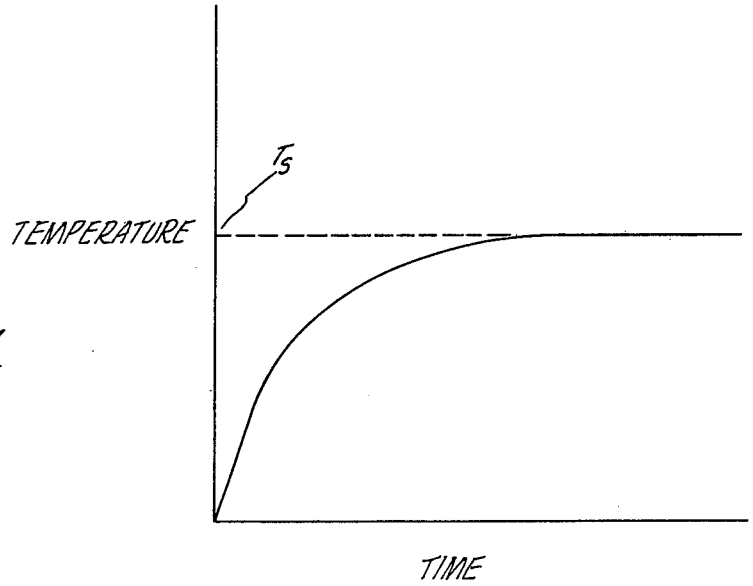
FIG. 14 is a graphical representation of a time-temperature curve for a typical polymeric P.T.C. composition.

In FIG. 12 is shown yet another article 80 in which the PTC layer is heated non-uniformly. In article 80, layers 81 and 82 are constant wattage layers of uniform thickness. Layer 83 is a PTC layer having a non-uniform cross-section being thicker in the center than at its edges. Over layers 81 and 82, a shown, are laid electrodes 84 and 85. When connected to power source 86, because of its non-uniform thickness, PTC layer 83 is heated more slowly in the middle and remains conductive in that region for a longer time. Accordingly, article 80 functions in a manner similar to that of FIG. 9 in that $T_s$ of PTC layer 83 will be reached last in the center. Variations of the article of FIG. 12 will be apparent to those skilled in the art. For example PTC layer 83 may be thicker at the ends than in the middle and conductivity be shut off first in the center. In another configuration, PTC layer 83 can be thicker at one edge than the other in which it will be rendered progressively non-conductive across its width. Although it usually preferably in these embodiments for the thickness of both constant wattage layers to vary in concert, those skilled in the art will realize that under certain circumstances it may be advantageous to have only one or the other layer vary or for them to vary independently and/or non-uniformly.

In FIGS. 10–12, the constant wattage layers may as in FIG. 9 be PTC layer having a $T_s$ higher than the intermediate PTC layer.

The self-regulating articles of the present invention are susceptible to numerous applications where it is desired to have the article heat initially to a relatively high temperature and subsequently reach a steady state at a relatively low temperature. Several such applications are mentioned above. A particularly preferred application is to provide a self-heating article that is heat recoverable in which the heat generated can be used to provide the heat for recovery. For example the higher temperature level might be used to cause recovery and the lower, steady state temperature, used to promote flow of an adhesive liner for the heat recoverable article after its recovery.

The heaters can be employed to heat chemical reactions where, for example, initially a high temperature is desired to initiate reaction, for example decomposition of a peroxide, and a lower temperature to maintain the reaction.

A specific application of the present invention is described in concurrently filed application, Horsma et al., "Heat Recoverable Self-Heating Article And Method of Sealing A Splice Therefrom," Ser. No. 601,344, having the same assignee as the present invention, the disclosure of which is incorporated by reference.

The articles described herein are shown as being planar for ease of description. It will be apparent to those skilled in the art that tubular self heating articles, which may be heat recoverable, can be made in accordance with the present invention as well as articles of other regular or irregular configurations Other applications than those disclosed will be apparent to those skilled in the art without departure from the teachings disclosed herein. Accordingly, the invention should be considered to be limited only by the appended claims.

We claim:

1. A self-regulating heating article when connected to a source of electrical current having a layered structure comprising:

a. a layer of electrically conductive material having a positive temperature coefficient of resistance (PTC layer) and an associated switching temperature $T_s$;

b. an electrical heating layer of constant wattage material (CW layer) having a higher resistance below $T_s$ than does said PTC layer to which it is connected in series;

c. electrical terminal connection for said heating article; and d. means for impeding the temperature increase in said PTC layer relative to said constant wattage layer when electrical connection is made to said source of current so that the PTC layer remains electrically conductive through a least a section of its thickness until the temperature of the CW layer rises above $T_s$.

2. An article according to claim 1 wherein said impeding means is a thermally insulating layer disposed between said CW layer and said PTC layer.

3. An article according to claim 2 wherein said insulating layer is an electrically conductive layer of lower resistance than said CW layer.

4. An article according to claim 3 wherein said insulating layer is a polymer foam.

5. An article according to claim 1 wherein said CW layer comprises a PTC material with a $T_s$ higher than that of said PTC layer.

6. An article according to claim 3 wherein said CW layer comprises a PTC material with a $T_s$ higher than that of said PTC material.

7. An article according to claim 2 further comprising a heat storage layer disposed on the side of the CW layer opposite said insulating layer.

8. An article according to claim 7 wherein said storage layer is electrically conductive.

9. An article according to claim 8 wherein said storage layer comprises a crosslinked crystalline polymer.

10. An article according to claim 3 comprising a second constant wattage layer disposed on the side of the PTC layer opposite said insulating layer, said 2nd CW layer below $T_s$ having a lower resistance than said CW layer but higher than said PTC layers.

11. An article according to claim 3 comprising a second thermally insulating layer and a second constant wattage layer disposed on the side of the PTC layer opposite said first PTC layer and said first insulating layer.

12. An article according to claim 2 having a second PTC layer disposed between said insulating layer and said CW layer, said second PTC layer having a $T_s$ higher than that of said first PTC layer and a second constant wattage layer disposed on the side of said first PTC layer opposite said insulating layer, said second constant wattage layer having a lower resistance than said first CW layer.

13. An article according to claim 1 wherein said article comprises a pair of CW layers disposed on either side of said PTC layer and a pair of descrete electrodes substantially parallel, each member of said pair being embedded in a different CW layer and diagonally spaced apart from each other on either side of said article.

14. An article according to claim 1 wherein said article comprises a pair of CW layer disposed on either side of said PTC layer and a pair of substantially parallel electrodes, each member of said pair being embedded in a different CW layer and spaced apart to define a line normal to the plane of the layers and near one of the edges of the article defined by the layers.

15. An article according to claim 1 wherein said article comprises a pair of CW layers on either side of said PTC layer, said CW layers having a non-uniform thickness.

16. An article according to claim 15 wherein the thickness of said CW layers increases from a minimum thickness at one edge to a maximum at the other.

17. An article according to claim 1 wherein said article comprises a pair of CW layers disposed on either side of said PTC layer, said PTC layer having a non-uniform thickness.

18. An article according to claim 17 wherein said PTC layer is thicker at its midsection than at either edge.

19. An article according to claim 1 that is heat recoverable.

20. An article according to claim 2 that is heat recoverable.

21. An article according to claim 3 that is heat recoverable.

22. An article according to claim 4 that is heat recoverable.

23. An article according to claim 5 that is heat recoverable.

24. An article according to claim 6 that is heat recoverable.

25. An article according to claim 7 that is heat recoverable.

26. An article according to claim 8 that is heat recoverable.

27. An article according to claim 9 that is heat recoverable.

28. An article according to claim 10 that is heat recoverable.

29. An article according to claim 11 that is heat recoverable.

30. An article according to claim 12 that is heat recoverable.

31. An article according to claim 13 that is heat recoverable.

32. An article according to claim 14 that is heat recoverable.

33. An article according to claim 15 that is heat recoverable.

34. An article according to claim 16 that is heat recoverable.

35. An article according to claim 17 that is heat recoverable.

36. An article according to claim 18 that is heat recoverable.

37. An article according to claim 13 wherein said electrodes are strip electrodes.

38. An article according to claim 13 wherein said electrodes are braided tubular electrodes.

39. An article according to claim 13 wherein said CW layers have substantially the same resistance and said resistance is uniform across their width.

40. An article according to claim 39 wherein said CW layers comprise a material having a positive temperature coefficient of resistance with a switching temperature $T_s$ above that of said PTC layer.

* * * * *